US005551270A

United States Patent [19]

Bajraszewski et al.

[11] Patent Number: 5,551,270

[45] Date of Patent: Sep. 3, 1996

[54] EXTRUSION FORMING OF INTERNAL HELICAL SPLINES

[75] Inventors: Alexander Bajraszewski, Richmond; David H. Dodds, South Lyon; Charles E. Muessig, Novi; Vijay Nagpal, Westland, all of Mich.

[73] Assignee: Ford Motor Company, Dearborn, Mich.

[21] Appl. No.: 276,591

[22] Filed: Jul. 18, 1994

[51] Int. Cl.[6] ..... B21K 1/30

[52] U.S. Cl. ..... 72/21.3; 72/117; 72/358

[58] Field of Search ..... 72/19, 117, 343, 72/352, 355.4, 358, 359, 260, 267, 21.3, 21.4; 29/893.34; 74/441

[56] References Cited

U.S. PATENT DOCUMENTS

| | | | |
|---|---|---|---|
| 1,985,833 | 12/1934 | Lampart . | |
| 2,997,969 | 8/1961 | Holmes, Jr. | 72/456 |
| 3,007,508 | 11/1961 | Giordano | 72/1 |
| 3,186,210 | 6/1965 | Lesher et al. . | |
| 3,267,712 | 8/1966 | Atkin . | |
| 3,583,190 | 6/1971 | Wildhaber | 72/102 |
| 3,813,909 | 6/1974 | Roger . | |
| 3,910,091 | 10/1975 | Samanta . | |
| 4,287,749 | 9/1981 | Bachrach et al. . | |
| 4,350,865 | 9/1982 | Backrach . | |
| 4,449,417 | 5/1984 | Sasaki | 74/441 |
| 4,452,060 | 6/1984 | Kanamaru et al. | 72/117 |
| 4,559,803 | 12/1985 | Langford et al. . | |
| 4,622,842 | 11/1986 | Bachrach et al. . | |
| 4,878,370 | 11/1989 | Fuhrman et al. . | |
| 4,924,690 | 5/1990 | Kanamaru et al. . | |
| 5,052,210 | 10/1991 | Hoge . | |
| 5,247,819 | 9/1993 | Morimoto et al. | 72/19 |
| 5,325,698 | 7/1994 | Nagpal et al. . | |

FOREIGN PATENT DOCUMENTS

| | | | |
|---|---|---|---|
| 2559239A1 | 7/1977 | Germany . | |
| 3915969A1 | 11/1990 | Germany . | |
| 187340 | 7/1992 | Japan | 72/358 |
| 927378 | 5/1982 | Russian Federation . | |

*Primary Examiner*—Lowell A. Larson
*Attorney, Agent, or Firm*—Donald A. Wilkinson

[57] ABSTRACT

An extrusion assembly, which fits into a hydraulic press, includes an upper die plate and a lower die plate mounted to one another by die guide posts. A lead bar is coupled to the upper die plate at one end and to a mandrel at its other end and includes helical grooves on its surface that mate with helical protrusions on lead nuts. A die shell and insert are mounted concentrically with mandrel and receive a gear blank. As hydraulic press pushes lead bar axially toward gear blank, lead nuts impart a rotational motion to lead bar, which causes mandrel to move with a helical motion as it is pressed into and pulled out of gear blank.

10 Claims, 2 Drawing Sheets

EXTRUSION FORMING OF INTERNAL HELICAL SPLINES

FIELD OF THE INVENTION

The present invention relates to the forming of internal helical gear teeth, and more particularly to the use of cold extrusion for forming a ring gear having internal helical teeth.

BACKGROUND OF THE INVENTION

Complex gear trains often use ring gears having internal teeth. Some of these gear trains, such as those used in automotive transmissions and the like, advantageously use helical gears rather than straight gears even though helical gear teeth are more difficult to form. Additionally, in many of these instances the internal gear teeth must be formed with very precise dimensions and spacing in order to perform adequately. Consequently the need arises to be able to fabricate ring gears having internal helical teeth that are precisely formed.

One method for precisely forming helical teeth is broaching, which is a cutting process. In broaching, a large broaching bar with cutting teeth is pulled through a gear blank to form the teeth. Broaching has drawbacks, however, in that it is an expensive process which requires a significant investment in expensive machinery and cutting tools. For example, a broaching bar that is used to form an internal helical ring gear for an automotive transmission may have to be as much as eight feet long, which is expensive to fabricate. Further, broaching can only be used on "through" parts since the long broach bar must be pulled through the inside of the gear blank to cut the teeth. Broaching, therefore, cannot be used at all to fabricate a blind end gear.

Gear shaping is another cutting process that can be used to fabricate internal helical teeth. Although it is a slower process than broaching, it can be used to form blind end as well as through parts for high volume production. Even so, this process also requires an investment in expensive machinery and cutting tools.

A process for the forming of internal helical gear teeth that is faster than shaping and broaching and requires less expensive tooling is cold extrusion. Cold extrusion is a process where teeth are formed into a part rather than cut into a part. A process for extruding internal teeth in a ring gear is disclosed in U.S. Pat. No. 4,878,370 to Fuhrman et al. The process disclosed therein is a two step process in which an annular work piece is advanced part of the way across external die teeth of a floating mandrel, and then a second work piece is inserted and used to push the first work piece through as the second one begins to be formed. Since each succeeding work piece is used to push the preceding work piece through, this process cannot produce blind end parts. Further, if helical teeth are being formed with the process disclosed in this patent, there is no external helical guidance while the teeth are being formed; only the helix of the die teeth are used to cause helical rotation of the work piece. This type of directional rotation will cause the amount of force that a hydraulic press must apply to extrude the work piece around the die teeth to increase since large friction forces will occur as the work piece slides along the annular inner surface of the die ring.

The need arises, then, when one desires to precisely form internal helical teeth in a blind end part to be able to extrude the gear teeth in a cost efficient manner.

SUMMARY OF THE INVENTION

In its embodiments, the present invention contemplates an apparatus for extrusion forming internal helical teeth in a blind end gear blank. The apparatus includes a press, having a first member and a base, with the first member coupled to and axially movable relative to the base. The apparatus further includes a lead bar coupled to the first member having an outer surface which includes helical guides, and a mandrel coupled concentrically to the lead bar and having an outer surface which includes helical die teeth. A lead nut assembly is mounted to the press having helical guides operatively engaging the helical guides on the lead bar, and a die is mounted to the base which includes a cavity concentrically located relative to the mandrel and adapted to receive the gear blank.

The present invention further contemplates a method of extrusion forming internal helical teeth in a blind end gear blank. The method comprises the steps of providing a die base with a generally cylindrical cavity adapted for receiving and aligning the gear blank; providing a mandrel, having helical die teeth on its external surface, concentrically located relative to the cavity; placing a blind end gear blank in the die base; moving the mandrel axially into the gear blank while rotating the mandrel; plunging the mandrel into the gear blank until the mandrel reaches a predetermined depth so as to extrude internal teeth in the gear blank, thereby forming a blind end gear; stopping movement of the mandrel; pulling the mandrel axially out of the blind end gear while rotating the mandrel in the opposite direction such that the helical die teeth of the mandrel will follow the same path as when the mandrel engaged the gear blank; and removing the blind end gear from the die base.

Accordingly, an object of the present invention is to form internal helical teeth in a blind end gear blank without having to use an expensive metal cutting process, while precisely controlling the helical rotation of the mandrel as it is pressed into the gear blank.

An advantage of the present invention is a cost reduction in forming blind end gears having internal helical teeth over conventional cutting methods.

A further advantage of the present invention is the precision with which a helical mandrel can be pushed into a gear blank and the reduced force required when a helical motion is imparted to the mandrel during the gear tooth extrusion process.

DETAILED DESCRIPTION OF THE PREFERRED EMBODIMENTS

Figure 1:
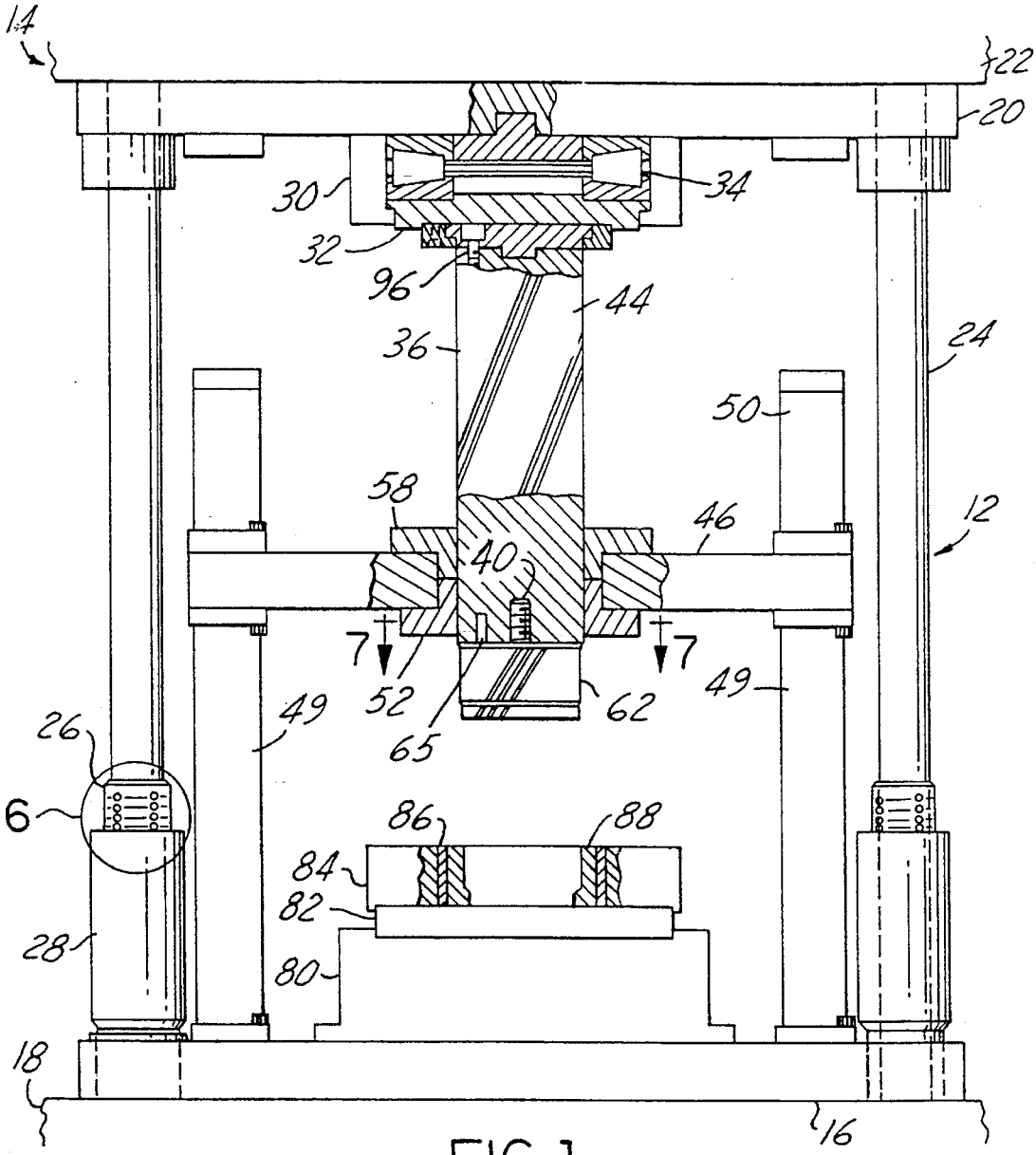
FIG. 1 is a side view of an extrusion press.
Figure 2:
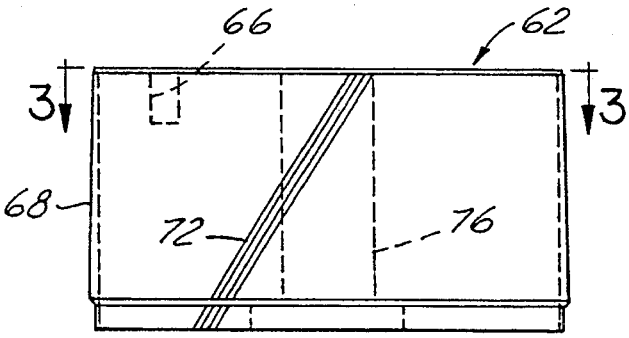
FIG. 2 is a side view of a mandrel as used in the extrusion press of FIG. 1.
Figure 3:
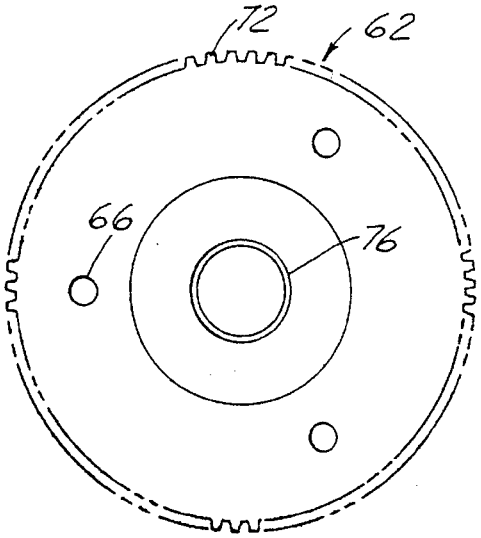
FIG. 3 is a sectional view taken along line 3—3 in FIG. 2.
Figure 5:
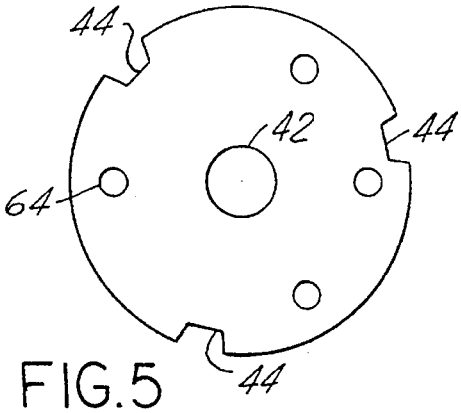
FIG. 5 is a sectional view taken along line 5—5 in FIG. 4.
Figure 4:
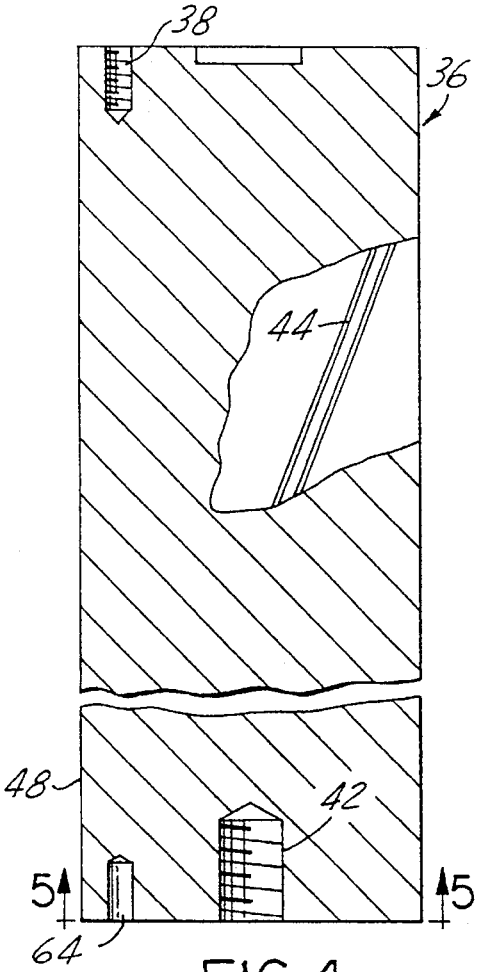
FIG. 4 is a side view of a lead bar as used in the extrusion press of FIG. 1.
Figure 6:
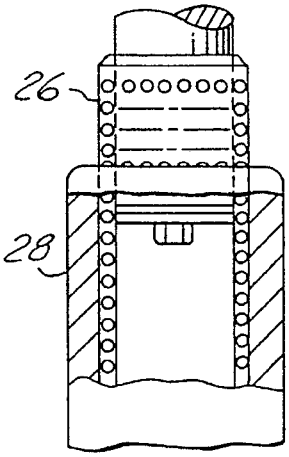
FIG. 6 is a side view, on an enlarged scale, taken from the encircled area 6 in FIG. 1.
Figure 7:
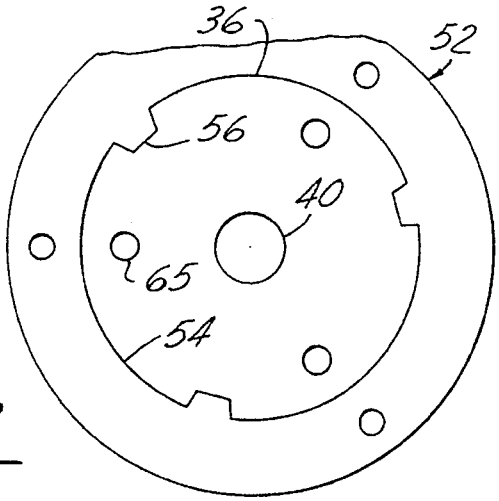
FIG. 7 is a sectional view taken along line 7—7 in FIG. 1.

An extrusion assembly 12 is mounted in a conventional hydraulic press 14. It includes a lower die plate 16, resting on a base portion 18 of press 14, and an upper die plate 20, attached to a press member 22 of hydraulic press 14. Die guide posts 24 extend between upper die plate 20 and lower die plate 16. One end of each die guide post 24 is fixed to upper die plate 20. The other end of each die guide post 24 has a ball bearing cage 26 attached to it. Affixed to lower die plate 16 are guide bushings 28, with each guide bushing 28 aligned with one ball bearing cage 26. Ball bearing cages 26 telescopically slide into their respective guide bushings 28 to allow axial movement of upper die plate 20 relative to lower die plate 16 while minimizing friction and maintaining the two parallel to one another.

A retaining clamp ring 30, affixed to upper die plate 20, retains a lead bar plate 32 and a thrust bearing 34, held between lead bar plate 32 and upper die plate 20. A generally cylindrical lead bar 36 extends out from and is affixed to lead bar plate 32, with fasteners 96 inserted in attachment holes 38 in lead bar 36. Three equally spaced helical grooves 44 run about the periphery of lead bar 36. The helix angle for grooves 44 will be determined so that the die teeth of a mandrel, discussed below, will enter a gear blank at the proper helix angle for the finished gear teeth.

Lead bar outer diameter 48 passes through an opening in a lead nut support member 46, which is generally perpendicular to lead bar 36. Lead nut support 46 is mounted to support posts 49. Support posts 49 are mounted to lower die plate 16 parallel to die guide posts 24. Lead nut support 46 is affixed to support posts 49. Stop posts 50 are mounted on top of lead nut support 46, directly above support posts 49. Stop posts 50 limit the travel of upper die plate 20. A fixed lead nut 52 is bolted to lead nut support 46. Fixed lead nut 52 is a generally ring shaped member with an inner diameter 54 that matches outer diameter 48 of lead bar 36. Three helical protrusions 56 protrude from inner diameter 54. Helical protrusions 56 are sized and spaced to align with and just fit into helical grooves 44 on lead bar 36.

An adjustable lead nut 58 is mounted on lead nut support 46 and also receives lead bar 36, similar to fixed lead nut 52, except that its attachment holes are slightly slotted. Fixed lead nut 52 and adjustable lead nut 58 are initially aligned with one another. As the extrusion assembly 12 is cycled many times while forming gears, a small amount of play may begin to occur due to wear between helical protrusions 56 and helical grooves 44. Adjustable lead nut 58, then, can be rotated slightly relative to fixed lead nut 52 so that the play is removed. This will prevent backlash from occurring between lead nuts 52 and 58 and lead bar 36.

A mandrel 62 is fastened to the end of lead bar 36 by a bolt 40, which slips through a bore 76 in the center of mandrel 62 and engages a center tap 42 in lead bar 36. Dowels 65 mate with dowel holes 64 in lead bar 36 and corresponding dowel holes 66 in mandrel 62. Mandrel 62 has a step 68, which includes die teeth 72. This single step mandrel 62 is preferred to a multi-step mandrel. However, if the material to be formed is very hard, then a multi-step mandrel may be needed since it has multiple sets of teeth with increasing diameter to distribute the load more evenly, leading to longer die tooth life. The helix angle of die teeth 72 is the same as that desired in the finished ring gears. As an alternative, a mandrel adapter, not shown, can be added between mandrel 62 and lead bar 36 that will account for height adjustments.

A load cell 80 is mounted on lower die plate 16. Load cell 80 has force sensors, not shown, mounted within it and is electrically connected to an analyzer, not shown. Load cell 80 will sense the amount of load and torque applied to it during the forming process. If the load is out of a predetermined range, then an operator controlling the press can stop the forming operation and check the equipment for any potential problems. Load cell 80 is optional, and the extrusion process can be conducted without this piece of equipment if so desired.

Mounted on load cell 80 is die base 82. A die shell 84 is mounted on die base 82 and includes a cylindrical central cavity. A ring shaped die insert 86 is fit into the cavity of die shell 84. Die insert 86 is sized to just fit gear blanks 88 within it. It supports gear blanks 88 radially, while die base 82 supports them axially during the forming process. Die shell 84 and die insert 86 are located so they will be concentric with lead bar 36 and stepped mandrel 62.

A typical ring gear blank 88 will include an annular shell of precise internal diameter in which the internal helical gear teeth-will be extruded during the forming process, with a lip protruding from the inner diameter at the blind end of the blank 88. A ring gear blank 88 is shown inserted into die insert 86, ready to undergo the gear teeth forming process.

This overall assembly is used to implement a cold extrusion process for forming internal helical teeth in blind end gear blanks 88, with tight control of lead accuracy. The process is a single step backward extrusion process.

A gear blank 88 is inserted into die insert 86 with its open end facing mandrel 62. Hydraulic press member 22 is activated and pushes on upper die plate 20. Upper die plate 20 will move axially toward lower die plate 16, guided by die guide posts 24.

This movement pushes lead bar 36 axially toward gear blank 88. Lead nut support 46, having lead nuts 52 and 58 mounted thereon, is fixed to support posts 49 and does not move axially. Consequently, as lead bar 36 moves axially, helical protrusions 56 on fixed lead nut 52 will engage helical grooves 44 on lead bar 36 and cause lead bar 36 to rotate.

The result of the axial and rotational motion of lead bar 36 will cause die teeth 72 on mandrel 62 to move forward in a helical motion. Die teeth 72 will engage the inner surface of gear blank 88 and, as they are pressed into gear blank 88, form helical gear teeth thereon. When the predetermined depth of finished gear teeth is reached, hydraulic press 22 stops pressing on upper die plate 20 and begins to pull on upper die plate 20. This movement will cause mandrel 62 to pull out of the finished ring gear. The motion of withdrawal will precisely follow that of insertion since lead bar 36 will rotate and move mandrel 62 through the same path as during insertion, thereby reducing the risk of nicking or deforming any of the gear teeth during removal of mandrel 62 from the finished ring gear.

The finished ring gear is then removed from die insert 86 and another gear blank 88 is inserted in its place in order to start the forming process over again.

As an additional optional step, through end parts can be produced by performing a conventional facing operation on the finished blind end ring gears to open up the blind end of each of the gears.

While certain embodiments of the present invention have been described in detail, those familiar with the art to which this invention relates will recognize various alternative designs and embodiments for practicing the invention as defined by the following claims.

We claim:

1. An apparatus for backward extrusion forming internal helical teeth in a blind end gear blank capable of forming finished gears comprising:

a press, including a first member and a base, with the first member coupled to and axially movable relative to the base, and the base axially supporting the blind end of the gear blank;

a lead bar coupled to the first member having an outer surface which includes helical guides;

a mandrel coupled concentrically to the lead bar and having an outer surface which includes helical die teeth;

a lead nut assembly mounted to the press having nut guides operatively engaging the helical guides on the lead bar for helically guiding the lead bar as it moves axially relative to the lead nut assembly; and a die mounted to the base including a cavity concentrically located relative to the mandrel and adapted to receive the gear blank.

2. An apparatus according to claim 1 wherein the helical die teeth of the mandrel comprise more than one set of teeth, with each set of teeth having a different diameter.

3. An apparatus according to claim 1 wherein the die comprises a die base mounted to the press base, a die shell mounted to the die base having a generally cylindrical cavity, and a ring shaped die insert received within the die base cylindrical cavity.

4. An apparatus according to claim 3 wherein the die further comprises a load cell, mounted between the die base and the press base, for ceasing the extrusion forming if the loads sensed are outside of a predetermined range.

5. An apparatus according to claim 1 further including a plurality of guide bushings affixed to the base of the press and a plurality of guide posts, each having a first and a second end, with the first end of each affixed to the first member of the press in alignment with its respective one of the guide bushings, and including ball bearing cages affixed to the second end of each guide post telescopically mounted within its respective guide bushing.

6. An apparatus according to claim 1 wherein the lead nut assembly comprises a lead nut support plate selectively fixed relative to the press base, a fixed nut coupled to the lead nut support plate and an adjustable lead nut coupled to the lead nut support plate, with the fixed and the adjustable lead nuts operatively engaging the lead bar.

7. An apparatus according to claim 1 wherein the helical guides on the lead bar comprise helical grooves and the nut guides on the lead nut assembly comprises protrusions received within the helical grooves.

8. A method of backward extrusion forming internal helical teeth in a blind end gear blank comprising the steps of:

providing a die base with a generally cylindrical cavity adapted for receiving and aligning the gear blank and axially supporting the blind end of the gear blank;

providing a lead bar having a surface with a helical guide formed therein;

providing a mandrel, having helical die teeth on its external surface, concentrically located relative to the cavity and affixed to the lead bar;

providing a lead nut assembly, selectively fixed relative to the die base, having a nut guide operatively engaging the helical guide on the lead bar;

placing a blind end gear blank in the die base;

moving the lead bar toward the gear blank, thereby causing the mandrel to move axially into the gear blank while rotating;

plunging the mandrel into the gear blank, causing compression in the gear blank, until the mandrel reaches a predetermined depth so as to backward extrude internal teeth in the gear blank, thereby forming a blind end gear;

stopping movement of the mandrel;

pulling the mandrel axially out of the blind end gear while rotating the mandrel in the opposite direction such that the helical die teeth of the mandrel will follow the same path as when the mandrel engaged the gear blank; and removing the blind end gear from the die base.

9. A method according to claim 8 further comprising employing a facing operation on the blind end of the gear to open up the blind end.

10. A method according to claim 8 further comprising:

providing a load cell mounted to the die base;

sensing the load applied to the die base by the mandrel while engaging the gear blank; and ceasing the extrusion forming if the loads sensed are outside of a predetermined range.

* * * * *